US005288130A

United States Patent [19]

Foster

[11] Patent Number: 5,288,130

[45] Date of Patent: Feb. 22, 1994

[54] CHAIR FOR THE LOWER BACK

[76] Inventor: Daniel N. Foster, 3014 S.W. 41st La., Apt. #36D, Gainesville, Fla. 32608

[21] Appl. No.: 877,864

[22] Filed: May 4, 1992

Related U.S. Application Data

[62] Division of Ser. No. 589,420, Sep. 28, 1990, Pat. No. 5,110,121.

[51] Int. Cl.[5] ..... B60N 2/46

[52] U.S. Cl. ..... 297/411.36; 482/137; 482/133; 482/121; 297/284.7; 297/304; 297/306; 297/353

[58] Field of Search ..... 297/284.4, 349, 345, 297/415, 411, 292, 354, 300, 338; 482/100, 134, 135, 136, 142; 128/25 R

[56] References Cited

U.S. PATENT DOCUMENTS

| | | | |
|---|---|---|---|
| 385,468 | 7/1888 | Mayfield | 297/411 |
| 1,527,754 | 2/1925 | Simon | 297/411 |
| 1,747,644 | 2/1930 | Oliver | 297/411 |
| 2,966,208 | 12/1960 | Wood | 297/411 |
| 4,208,049 | 6/1980 | Wilson | 272/140 X |
| 4,285,515 | 8/1981 | Gezari | 272/134 X |
| 4,349,195 | 9/1982 | Johnston | 272/134 |
| 4,462,252 | 7/1984 | Smidt et al. | 272/134 |
| 4,600,196 | 7/1986 | Jones | 272/142 X |
| 4,699,425 | 10/1987 | Ohlson | 297/349 |
| 4,702,108 | 10/1987 | Amundsen et al. | 272/134 X |
| 4,725,055 | 2/1988 | Skowronski | 272/144 X |
| 4,725,056 | 2/1988 | Rehrl et al. | 272/144 X |
| 4,755,615 | 8/1988 | Case | 272/134 X |
| 4,768,775 | 9/1988 | Marshall | 272/134 X |
| 4,802,462 | 2/1989 | Reiss et al. | 272/134 X |
| 4,811,946 | 3/1989 | Pelczar | 272/136 X |
| 4,844,055 | 7/1989 | Rawcliffe | 272/125 X |
| 4,858,919 | 8/1989 | Jones | 272/134 |
| 4,902,009 | 2/1990 | Jones | 272/134 |
| 4,979,778 | 12/1990 | Shields | 297/300 |
| 4,993,164 | 2/1991 | Jacobson | 297/284.4 |
| 4,997,054 | 3/1991 | Denny et al. | 297/411 |
| 5,002,269 | 3/1991 | Jones | 272/134 X |
| 5,004,230 | 4/1991 | Jones | 272/134 |

FOREIGN PATENT DOCUMENTS

| | | | |
|---|---|---|---|
| 3343634 | 6/1985 | Fed. Rep. of Germany | 272/143 |
| 2324324 | 4/1977 | France | 272/144 |
| 2608440 | 6/1988 | France | 272/134 |

*Primary Examiner*—Richard J. Apley
*Assistant Examiner*—Jerome Donnelly
*Attorney, Agent, or Firm*—Arthur G. Yeager

[57] ABSTRACT

A chair is specifically designed to be usable as an ordinary office chair. The chair employs both anterior and posterior pelvic restraints to prevent rotation of the pelvic region. Several adjustment devices permit proper movement up and down and back and forward of the arm rests so that they may be used as anterior pelvic restraints during exercise.

20 Claims, 3 Drawing Sheets

CHAIR FOR THE LOWER BACK

This application is a division of application Ser. No. 07/589,420, filed Sep. 28, 1990, now U.S. Pat. No. 5,110,121 issued May 5, 1992.

CROSS-REFERENCE

This application is based on a previously filed Document Disclosure No. 199005, filed Aug. 12, 1988.

BACKGROUND OF THE INVENTION

1. Field of the Invention

The present invention relates to chairs, particularly chairs for the lower back and exercise chairs designed to be used in strengthening the back muscles.

2. Proir Art

Many exercise devices exist for strengthening the back muscles. However, studies have shown that exercises to strengthen a particular group of muscles, whether in the back or elsewhere, have limitations because of muscle interactions. In particular, exercises for the muscles of the trunk are difficult to accomplish because of interaction of the muscles with other quite powerful muscles particularly those of the legs. Accordingly, stabilization of the pelvic region during the exercise is quite important. With particular reference to the muscles of the lower back, stabilization of the pelvis to prevent rotation thereof during an exercise routine is needed to isolate the lumbar region and provide for an acceptable exercise apparatus. None of the exercise devices in the prior art are effective in pelvic stabilization. See Peterson, et al., Comparison of the effectiveness of two pelvic stabilization systems on pelvic movement during maximal isometric trunk extension and flexion muscle contractions, Physical Therapy, 534–539 (April 1987).

BRIEF SUMMARY OF THE INVENTION

In one aspect of the present invention there is provided an exercise chair for the lower back which includes a base disposed firmly on a floor and having a seat disposed spaced above a floor with a front thigh-supporting portion and a rear portion and body positioning means movably mounted to the base and including a first and second spaced pelvic restraint means for engaging the pelvis to inhibit rotational movement of the pelvis of the user during an exercise movement. Selective resistance means are mounted between the body positioning means and the base to bias during an exercise movement the body positioning means against rearward movement of the body positioning means in response to user force applied by the back of the user.

In other aspects, the selective resistance means includes a plurality of selectively engagable resistance springs mounted between the base and the back positioning means via a hook member. The base includes selective means for engaging each spring by the base to vary the bias applied against the back positioning means by the resistance means. The first pelvic restraint means includes a posterior pelvic restraint pad positioned against the posterior pelvis of a user. The second pelvic restraint means includes a pair of spaced anterior pelvic restraint pads adapted to be positioned against the anterior pelvis adjacent each side of a user. The first and second pelvic restraint means cooperate to inhibit rotation of a pelvis when positioned against a body of a user.

Further aspects of the invention as a chair for general use include selectively operable adjustment means for mounting each pad to the chair for adjustment of the position thereof and being selectively positionable for use as arm rests by a user sitting in the chair by selective operation of the adjustment means. The base also includes a plurality of laterally extending legs at least one pair of which are disposed rearwardly and extend rearwardly a predetermined length to provide rearward lateral stability of the chair when exercises are being performed by a user. Each leg includes a wheel for movement of the chair thereon and selective locking means for inhibiting the rotation of respective wheel when the means is selectively locked to provide the versatility of using the chair as a desk chair in an office or the like.

The chair includes various adjustments for mounting each pad to the chair for adjustment in height and for forward or rearward horizontal movement thereof. The seat is also adjustable in height and rotatable through 360 degrees and lockable in position. The back positioning means includes an upper back support pad which is adjustable in vertical position against the upper back of a user and movable at least 80 degrees.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE PREFERRED EMBODIMENT

Figure 1:
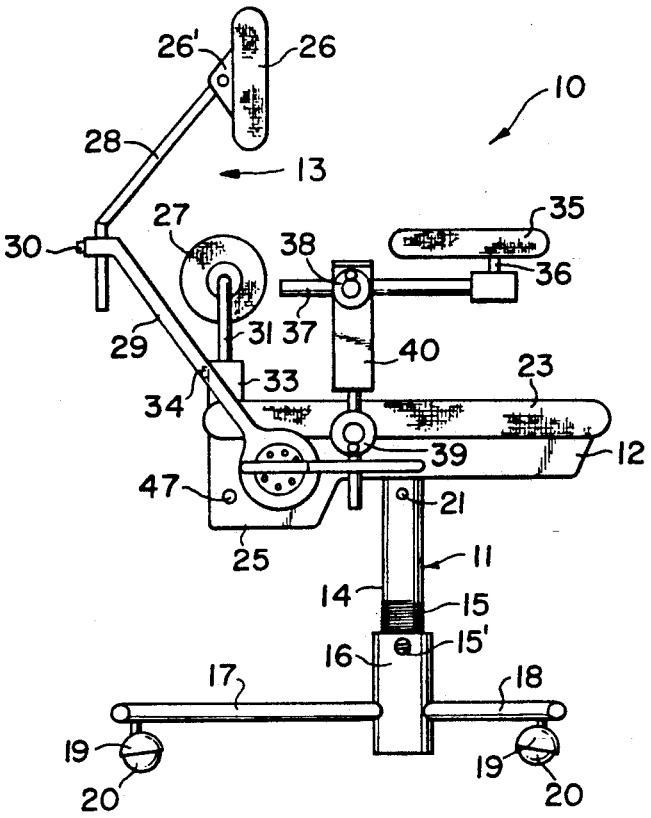
FIG. 1 is a right side elevation view of the exercise chair in accord with the present invention.

With reference now to the drawings, the exercise chair in accord with the present invention is depicted at numeral 10 in FIG. 1. The exercise chair 10 includes a base 11 for support and height adjustment; a seat 12 also having selectively operable position adjustments; and back positioning apparatus 13. Base 11 includes selectively operable adjustment means to mount the seat 12 including support shaft 14 having a threaded section 15 for height adjustment held in position via bolt 15'. A cylindrical frame 16 provides a center for two long rear legs 17 and forward legs 18 of the usual length. Locks 19 prevent movement of wheels 20.

Seat 12 includes a seat frame 22 mounted to be rotatable 360 degrees with respect to the base 11 and secured in a forward position by pin 21 to prevent rotation with respect to base 11. Cushion 23 is standard.

The back positioning apparatus 13 includes a selection mechanism 24 which will be described in more detail hereinbelow and is mounted in a housing 25 that is preferably integral with seat frame 22, and an upper back support pad 26 which includes bracket 26' and is mounted directly above two lumbar support pads 27 that function as posterior pelvic restraints. Pad 26 is mounted on a support arm 28 with pin 30 being used for height adjustment via pin holes 28' and boss 29' with support arm 29 being movable.

Figure 2:
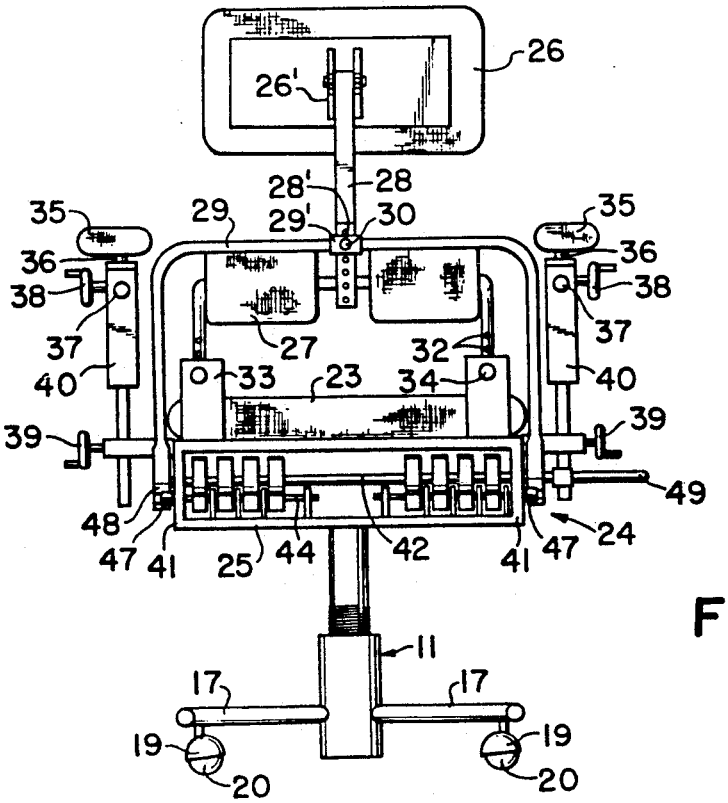
FIG. 2 is a front elevation of the chair of FIG. 1 with the arm rests positioned for use in an exercise routine.
Figure 3:
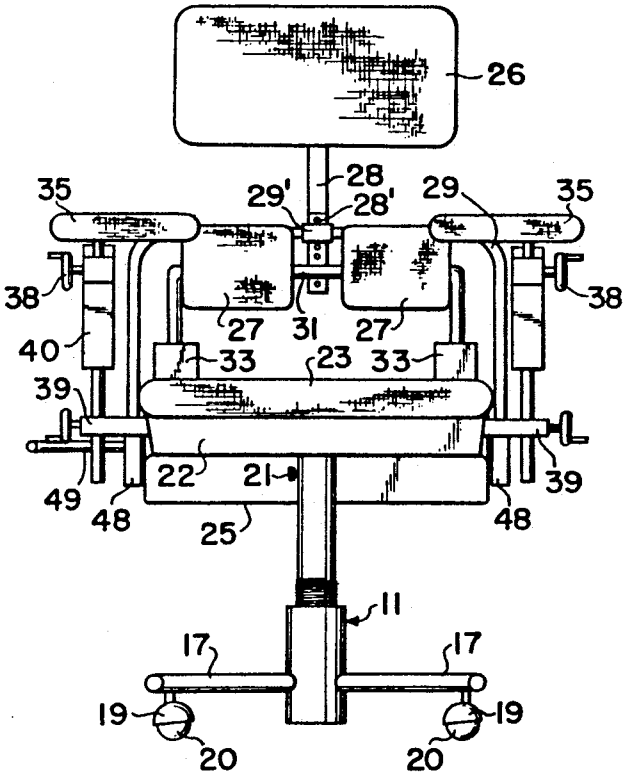
FIG. 3 is a rear elevation of the chair of FIG. 1 with part of the seat housing removed to illustrate the resistance mechanism.

Support pads 27 are rotatably mounted on a generally U-shaped axle 31, with pin holes 32 for adjustable height via pins 34, on support posts 33 rigidly mounted to seat frame 22 (FIGS. 2–3). The two arm rests 35 can be turned inwardly about the axis of post 36 and locked in position for use as anterior pelvic restraints. The arm rests 35 are mounted on mechanical adjustment means including a swivel post 36 connected to the end of a grooved slidable rod 37 which is rotatably operable only by crank mechanism 38. The arm rest assemblies are mounted on support posts 40 also employing a slidable rod/crank height adjustment assembly 39 substantially identical to 37 and 38. The arm rests 35 are pivotally mounted forwardly to allow them to swivel inboard from the rear to the FIG. 1 position and no locking means need be used to hold them in place because the arm rests 35 are rotatable only 90 degrees to the FIG. 3 position.

Figure 4:
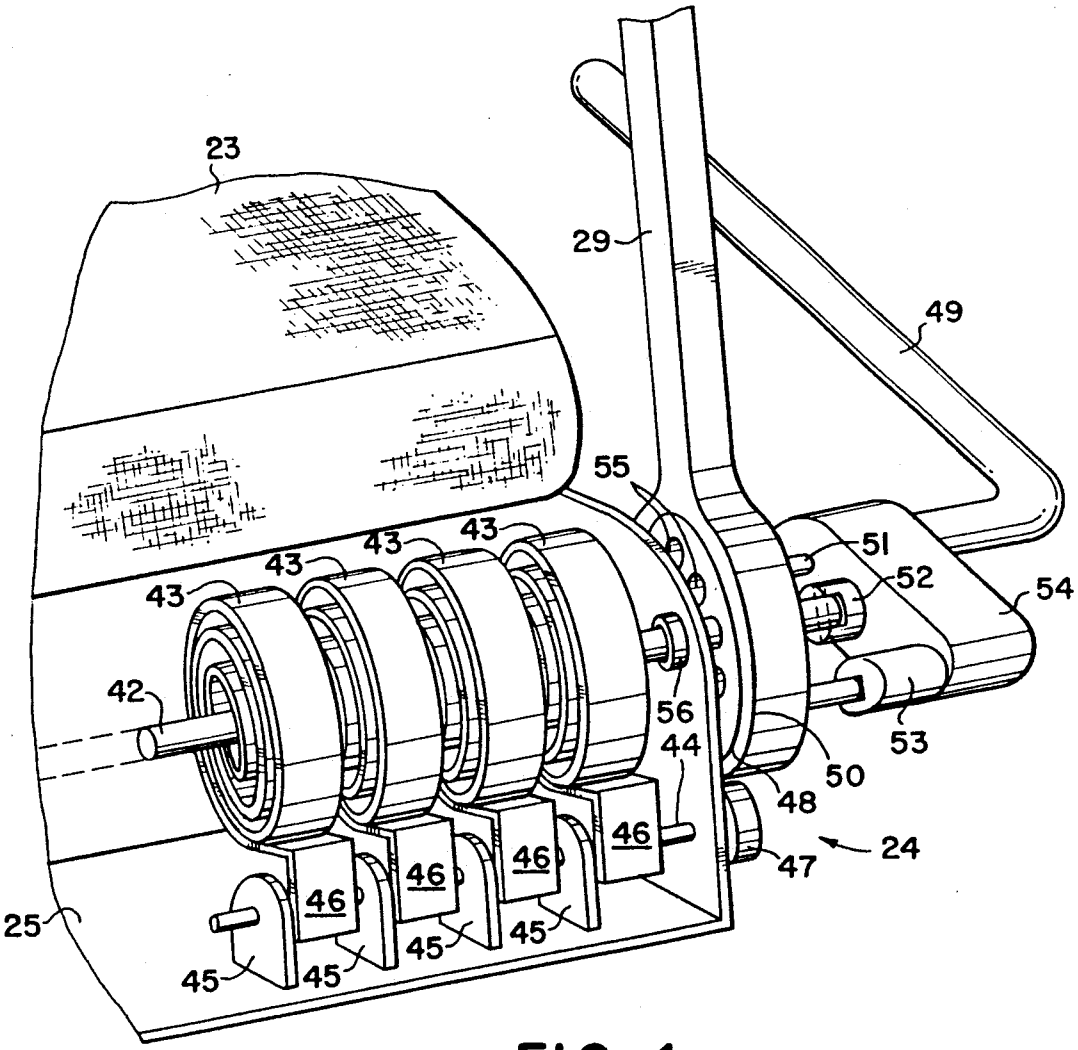
FIG. 4 is a partial perspective view of the variable resistance apparatus in accord with the present invention.

The selection mechanism 24 is mounted below seat 23 and contains variable resistance which is applied via support arm 29 to pad 26. FIG. 4 illustrates a portion of the mechanism 24. Both lower ends of support arm 29 are formed as loops 50 that fit on sprockets 48 which are located just outboard of housing 25. The end walls 41 of housing 25 includes an axle 42 extending laterally there across and mounted to sprockets 48 which are mounted to the outside of walls 41. Springs 43 are mounted on the axle 42 by welding or other appropriate means and include a lower "L-shaped" end 46 which is formed as a hook member to engage pin 44 as axle 42 is rotated counterclockwise (as viewed from the right side of the chair, FIG. 1). Accordingly, as support arm 29 is rotated rearwardly by force against pad 26 it will be resisted by a force determined by the number of springs 43 engaged sequentially by pin 44. Knob 47 can be grasped to pull pin 44 outwardly and thus allow an end 46 to rotate with spring 43 and provide no resisting force. The chair 10 has eight springs 43, four on either side and the springs 43 in each group of four are selected by a pin 44. Brackets 45 are used to support the pin 44.

Hand lever 49 connects to a body portion 54 having a selection pin 51 and two hinges: center hinge 52, for center of sprocket 48, and outside hinge 53 for connection to end 50 of arm 29. Hinges 52 and 53 allow for the lever 49 to be moved from sprocket 48 and allow end 50 to rotate freely around sprocket 48 via selection pin 51. Lever 49 is pulled outwardly to disengage pin 51 from sprocket 48 and allow end 50 to rotate freely around sprocket 48. Thus, with lever 49 pulled outwardly, downward pressure on the lever 49 will cause end 50 to rotate around sprocket 48 and cause the back support pad 26 to move forwardly (to follow the user bending forwardly). If the lever 49 is now pushed inwardly, pin 51 will engage a slot in sprocket 48, engaging the selected resistance springs 43 with back pad 26 via arms 29. If the user pushes rearwardly to return to the upright position, the force encountered is determined by the number of springs 43 that have been engaged by movement of respective pins 44. Each spring 43 is rated at 25 lbs. force. Preferably axle 42 is mounted on bearings 56 to better distribute the force loading thereon.

The operation and use of the chair 10 is as follows. The height of the seat frame 22 is adjusted in the usual manner by rotating the threaded support shaft 14 in frame 16 and locking it in position via bolt 15'. The wheels 20 are locked via locks 19 to stabilize the chair 10 in position to not roll during movement by a user. The seat frame 22 is rotated to the forward position and locked into place via pin 21 to prevent rotation of seat frame 22 with respect to base 11. The height of pads 26 and 27 are adjusted as discussed above. Pads 27 are placed against the posterior pelvis to perform as posterior pelvic restraint pads and arm rests 35 are rotated into position as anterior pelvic restraint pads. The posterior restraint pads 27 are to be positioned prior to the anterior pads 35.

Figure 5:
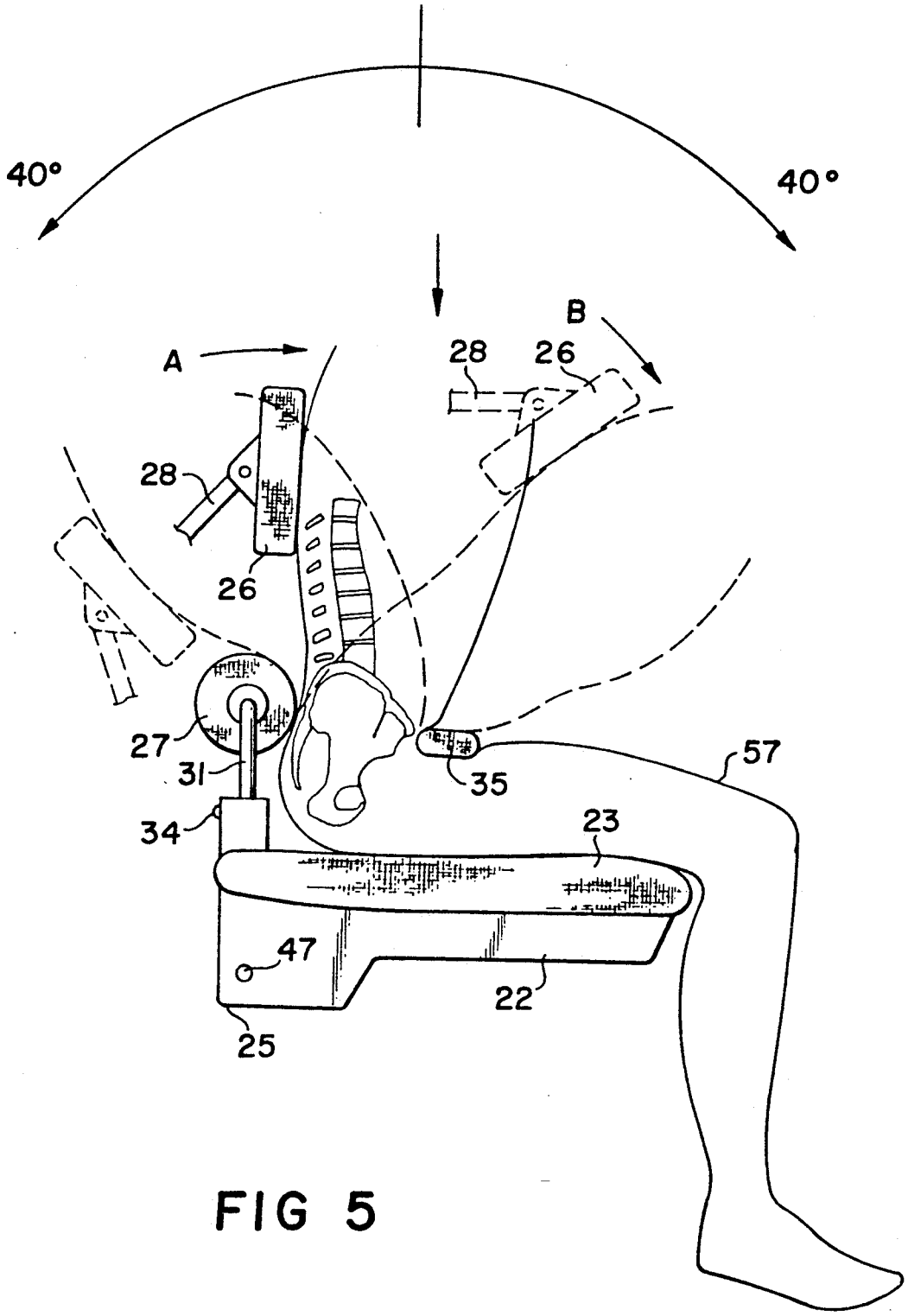
FIG. 5 is a diagrammatic illustration of body movement when using the chair for exercising the muscles of the lower back.

With the chair 10 adjusted for the user 57, exercise is performed by leaning forward at the waist and forcing the back pad 26 in contact with the user's back by pushing downwardly on hand lever 49 which has been moved outwardly to disengage pin 51 from sprocket 48, (FIG. 5). Once the user has moved forwardly the desired distance, which may be up to 40 degrees in arc, the lever 49 is pushed inwardly and pin 51 is engaged into a slot 55 of sprocket 48. At this point, the user 57 moves rearwardly 80 degrees against the resistance assembly to allow the support arms 29 to be moved to the desired position for normal sitting. Pin 47 is pushed inward to engage all springs 43 for support in the seated position. The lever 49 is then pushed inwardly to engage the sprocket 48 via pin 51 to keep the back pad 26 in the desired position during normal use of the chair 10. Arm rests 35 are returned to the normal position and a locking mechanism may be included to hold them in the arm rest position. The chair 10 is designed so that a user may obtain full range-of-motion of the lower back muscles (lumbar extensors) by being movable rearwardly of the upright position.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A chair for general use and adapted for movement of the lower back of a user comprising a base adapted to be disposed firmly on a floor and having a seat disposed spaced above a floor, selectively operable first adjustment means for mounting said seat to said base for positioning thereof, said seat being adjustable in height and rotatable through 360 degrees by selective operation of said first adjustment means, a pair of spaced apart arm rests, selectively operable second adjustment means for mounting each respective said arm rest to said base for adjustment of the height thereof in response to selective operation of said respective second adjustment means, selectively operable third adjustment means for mounting said respective arm rests for forward or rearward horizontal movement thereof in response to selective operation of said respective third adjustment means.

2. The chair as defined in claim 1 further including back support means, said back support means including two spaced apart lumbar support pads, selectively operable fourth adjustment means for mounting said pads to said base for adjustment of the height thereof in response to selective operation of said fourth adjustment means.

3. The chair as defined in claim 2 wherein said back support means further includes an upper back support pad, selectively operable fifth adjustment means for mounting said upper back support pad to said base for adjustment of the height thereof in response to selective operation of said fifth adjustment means.

4. The chair as defined in claim 1 further including back support means for supporting a back of a user, said back support means including a posterior pelvic restraint member, and adjustable mounting means for said posterior pelvic restraint member for selective positioning thereof.

5. The chair as defined in claim 1 wherein said seat includes a front thigh-supporting portion and a rear portion, back support means movably mounted to said base, a first and second spaced substantially rigid pelvic restraint means for engaging the pelvis at the posterior and anterior thereof respectively to inhibit rotational movement of the pelvis of a user during a rearward movement of a back of a user, and selective resistance means mounted between said back support means and said base to bias said back support means against rearward movement of said back support means in response to user force applied by a back of a user.

6. The chair as defined in claim 5 wherein said first pelvic restraint means includes a lumbar support means positioned against the posterior pelvis of a user.

7. The chair as defined in claim 5 wherein said selective resistance means includes a plurality of resistance springs mounted between said base and said back support means, said base including selective means for engaging each said spring by said base to vary the bias applied against said back support means by said resistance means.

8. The chair as defined in claim 5 wherein said lumbar support means includes two spaced apart lumbar support pads positioned against the posterior pelvis of a user.

9. The chair as defined in claim 8 wherein said second pelvic restraint means includes said pair of spaced apart arm rests which also function as anterior pelvic restraint pads when positioned against the anterior pelvis adjacent each side of a user, said first and second pelvic restraint means cooperating to inhibit rotation of a pelvis when positioned against a body of a user.

10. The chair as defined in claim 9 wherein said second and third adjustment means being operable to position said arm rests normally by a user sitting in said chair and to position said arm rests onto the anterior pelvis during rearward movement of a back of a user.

11. The chair as defined in claim 1 wherein said base includes a plurality of wheels for movement of said chair thereon and further including selective locking means for inhibiting rotation of said wheels when selectively locked.

12. The chair as defined in claim 1 wherein said base includes a plurality of laterally extending legs at least a pair of said legs being disposed rearwardly and extending rearwardly a predetermined length to provide rearward lateral stability of said chair.

13. The chair as defined in claim 11 wherein each said leg includes a wheel for movement of said chair thereon, each said leg further including selective locking means for inhibiting the rotation of respective said wheel when said means is selectively locked.

14. The chair as defined in claim 1 wherein said back support means is mounted to said base to be movable through an angle of at least 80 degrees.

15. A chair for general use comprising a base adapted to be disposed on a floor and having a seat disposed spaced above a floor, and a back support means for a supporting a back of a use, selectively operable first adjustment means for mounting said seat to said base for positioning thereof, said seat being adjustable in height and rotatable through 360 degrees by selective operation of said first adjustment means, a pair of spaced apart arm rests, selectively operable second adjustment means for mounting each respective said arm rest to said base for adjustment of the height thereof in response to selective operation of said respective second adjustment means, selectively operable third adjustment means for mounting said respective arm rests for forward and rearward horizontal movement and positioning thereof in response to selective operation of said respective third adjustment means.

16. The chair as defined in claim 15 wherein said back support means including two spaced apart lumbar support pads, selectively operable fourth adjustment means for mounting said pads to said base for adjustment of the height thereof in response to selective operation of said fourth adjustment means.

17. The chair as defined in claim 16 wherein said back support means further includes an upper back support pad, selectively operable fifth adjustment means for mounting said upper back support pad to said base for adjustment of the height thereof in response to selective operation of said fifth adjustment means.

18. The chair as defined in claim 15 further including back support means for supporting the back of a user, said back support means including a posterior pelvic restraint member, and adjustable mounting means for said posterior pelvic restraint member for selective positioning thereof.

19. The chair as defined in claim 18 wherein said posterior pelvic restraint member includes two spaced apart lumbar support pads.

20. The chair as defined in claim 19 wherein said arm rests when positioned to engage respectively each anterior pelvic portion of a user cooperating with said lumbar support pads to inhibit rotational movement of the pelvis of a user.

* * * * *